United States Patent [19]

Webb et al.

[11] Patent Number: 4,580,349

[45] Date of Patent: Apr. 8, 1986

[54] RANGE FINDER FOR A BOW

[76] Inventors: Leamon G. Webb; Charley B. Davis, both of Rte.2, Webber Falls, Okla. 74470

[21] Appl. No.: 731,278

[22] Filed: May 7, 1985

[51] Int. Cl.[4] ..... F41G 1/46

[52] U.S. Cl. ..... 33/265

[58] Field of Search ..... 33/265; 124/87

[56] References Cited

U.S. PATENT DOCUMENTS

| | | | |
|---|---|---|---|
| 2,925,656 | 2/1960 | Genovese | 33/265 |
| 3,013,336 | 12/1961 | Pennington | 33/265 |
| 4,400,887 | 8/1983 | Mason | 33/265 |
| 4,494,313 | 1/1985 | Scott | 33/265 |
| 4,542,591 | 9/1985 | Montgomery | 33/265 |

*Primary Examiner*—Richard R. Stearns

*Attorney, Agent, or Firm*—Head, Johnson & Stevenson

[57] ABSTRACT

A range finder for a bow formed of a frame in the form of a thin plate affixed at its rearward end to the bow and extending forwardly and in the plane of the bow, a plurality of adjustably positionable sight pins being affixed to the frame portion forwardly of the bow to extend perpendicularly from it, a pendulum member affixed to the frame at a point rearwardly of the sight pins, the pendulum member including a downwardly extending weight portion which pivots in a plane parallel the frame and a pointer portion, the outer end of the pointer portion being bent to form a pendulum needle which extends perpendicular the frame and adjacent to and parallel the sight pins, and a range bar affixed to the frame between the pendulum needle and the sight pins of the range bar extending perpendicular to the frame and providing an indicia receiving surface thereon so that marks may be made on the range bar corresponding to the position of the pendulum needle at positions of proper sighting of the various range pins.

2 Claims, 8 Drawing Figures

RANGE FINDER FOR A BOW

SUMMARY OF THE INVENTION

While a bow and arrow is one of the oldest implements employed by humankind for purposes of hunting game, improvements are still being made in the implement for greater accuracy. Most important consideration is aiming a bow in the range, that is, the distance to target. Since an arrow is a weighted missile, it is affected by gravity and therefore in the process of falling to the earth as soon as it leaves the bow. To compensate for the affect of gravity the arrow must be arched upwardly and the amount of upward arch necessary is related to the distance to the target. For this reason, sights have been provided for bows in which a plurality of sight pins are set for varying target distances. The problem, however, is in sighting the bow to make sure that it is held in the proper position relative to the gravitational attraction of the earth so that when the sight pin is utilized for a target at a selective distance the bow is accurately held for that distance.

The present invention provides an improved range finder sighting system for a bow including a frame in the form of a thin sheet having a forward and rearward end. The rearward end is secured to the bow and the frame extends forwardly from and in the plane of a bow. A plurality of vertically adjustably positionable sight pins are secured to the frame forward portion. Each of the sight pins extends perpendicularly from the frame and each has, at its outer end, a sight point.

A pendulum member is pivotally supported to the frame at a point intermediate the forward and rearward ends. The pendulum member includes a first portion which is weighted and therefore extends always, when the range finder is in use, in a directly downward position as it responds to the pull of gravity. The other portion of the pendulum member is a pointer portion and the outer end is bent to form a pendulum needle extending perpendicular to the frame. In the preferred arrangement the frame has an arcuate slot; the center of curvature of the slot being the point of pivotation of the pendulum member. In this preferred arrangement the pendulum is supported on one side of the frame and the pendulum needle extends through the slot and perpendicular to the plane of the frame.

A range bar is fixed to the frame between the pendulum needle and the sight pins. The range bar includes a surface which is adaptable to receiving markings thereon. The user can then mark the range bar within indicia corresponding to the position of the pendulum needle for each of the range pins so that the bow can be held uniformly with respect to different distances to insure accuracy of the bow sighting.

DETAILED DESCRIPTION OF THE DRAWINGS

Figure 1:
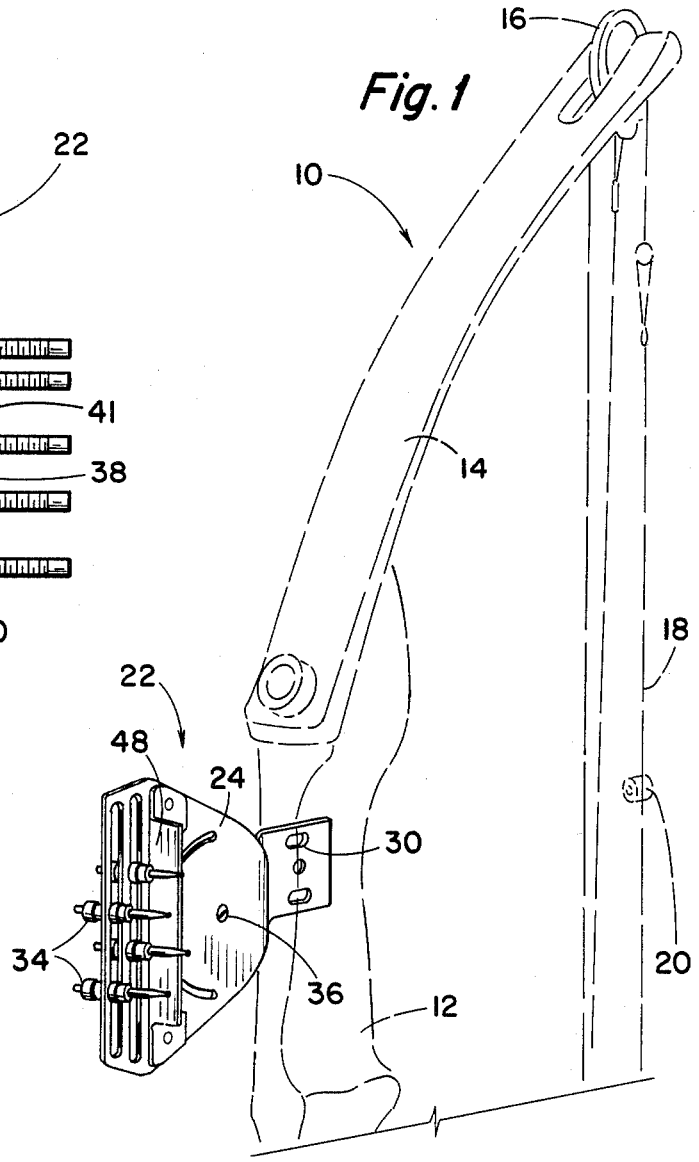
FIG. 1 shows, in dotted outline, the upper portion of a compound bow and in solid outline an isometric view of the range finder sight of this invention.

Referring to the drawing and first to FIG. 1, a compound bow is generally indicated by the numeral 10 and includes a central body portion 12 with the upper flexible portion 14 of the bow being shown, the opposite, lower flexible portion of the bow not being seen. The compound bow has a roller 16 at the outer end of the flexible portion 14 and a bow string 18 arranged in a manner for taking advantage of the compound aspect of the bow. A sight 20 is affixed to string 18 and is of the type commonly used through which the user sights the bow.

Shown in solid outline in FIG. 1 is the range finder sight of this invention generally indicated by numeral 22. Referring to FIGS. 2 through 6 the details of the range finder sight 22 are shown.

The sight is formed of a frame 24 preferably of relatively thin metal having a forward end 26 and a rearward end 28. The frame is supported in the plane of the bow and the rearward portion adjacent the rearward end 28 includes openings 30 by which the frame 24 may be secured to a bow body as shown in FIG. 1. Screws which would hold the range finder sight to the bow body are not shown but such screws or bolts would extend through the openings 30.

Figure 4:
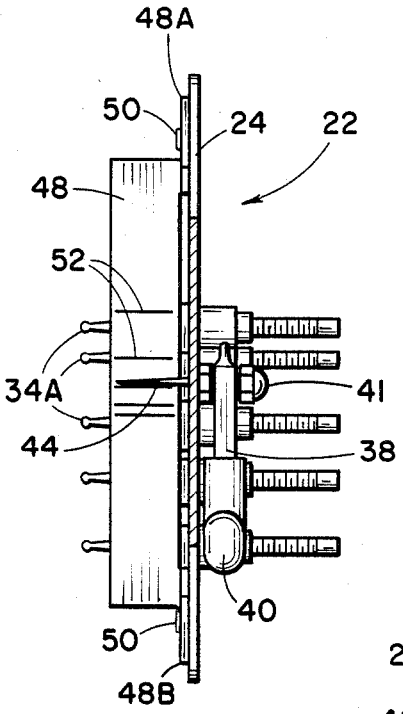
FIG. 4 is a cross-sectional view taken along the lines 4—4 of FIG. 2 showing generally the appearance of the range finder as seen by a user holding the bow for sighting.
Figure 5:
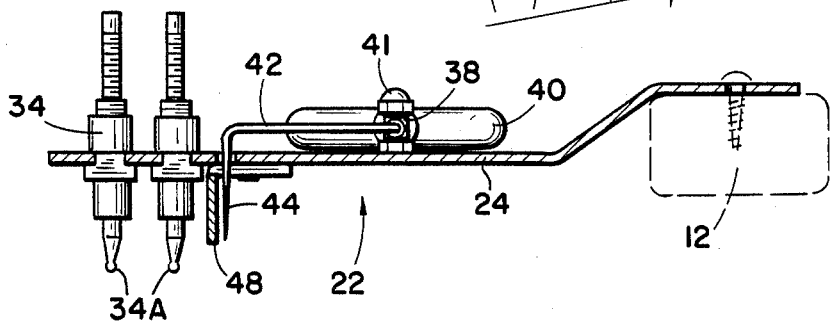
FIG. 5 is a horizontal cross-sectional view taken along the line 5—5 of FIG. 2.
Figure 3:
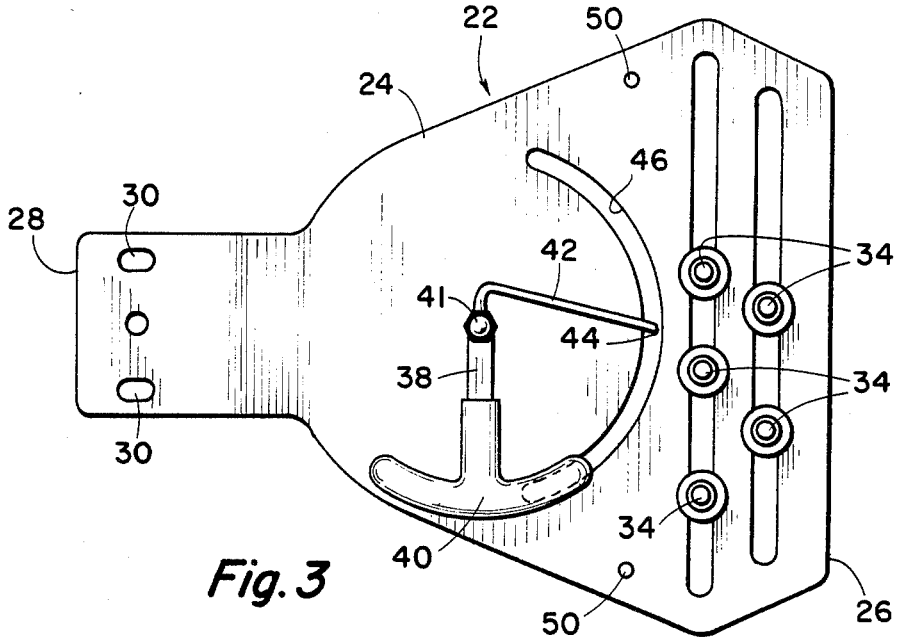
FIG. 3 is a rear elevational view of the range finder.

Adjacent the frame forward end 26 are two elongated vertical slots 32A and 32B, each of which receives a plurality of sight pins 34. Sight pins 34 are commonly employed as used on bow sights and include, as shown in FIGS. 4 and 5, at the outer end of each sight bead 34A. The sight pins are variably elevationally adjustable on the frame 22 and can also be adjustable so that spacing of the sight beads 34A from the frame is adjustable. As previously indicated the sight pins 34 are a known expedient and a variety of such sight pins exist and are available on the market, and therefore, the specific details of the sight pins are not a part of the present invention.

Figure 2:
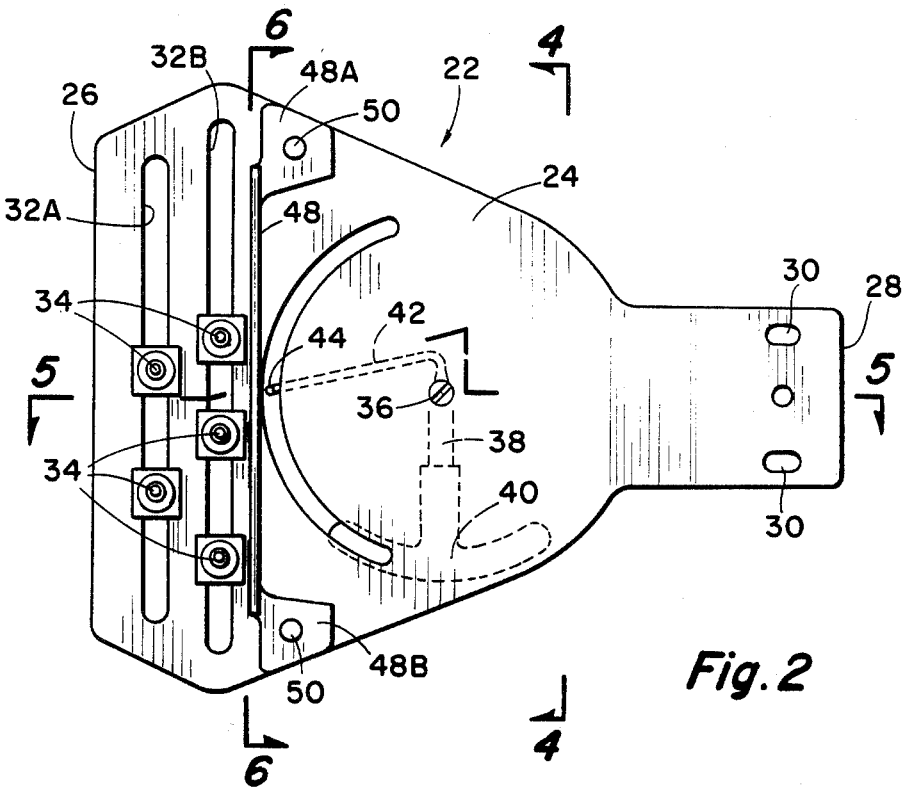
FIG. 2 is an enlarged front elevational view of the range finder of this invention.

Secured to the frame 24 is a small bolt, the head 36 of which is seen in FIGS. 1 and 2. Pivotally secured to the bolt is a pendulum member 38. The pendulum member includes a downwardly extended weighted portion 40 and, extending in the opposite direction, is a pointed portion 42. The pendulum portion 40 may be made of a heavy material such as steel or lead; however, the specific shape of the pendulum portion is not critical. The shape illustrated is preferred since it provides a weighted pendulum retained within the confines of frame 24.

The pointer portion 42 is bent and extends forward. The outer end of the pointer portion is bent at 90° to provide a needle 44. The frame 24 has an arcuate slot 46 formed in it, the center of curvature of the slot 46 being the bolt which supports the pendulum member 38. The needle portion 46 of the pendulum extends through slot 46.

Affixed to the frame between needle 44 and sight pins 34 is a range bar 48. The range bar is an elongated, thin, flat portion, the main body of which extends perpendicular to frame 24. The outer ends 48A and 48B are bent at right angles to the range bar main portion to provide means for affixing the range bar to the frame. Rivets 50 extends through the portions 48A and 48B and the frame to hold the range bar in place.

The rearward surface of the range bar has an indicia receiving surface on it providing means for placement of markings 52 thereon as seen in FIG. 4. The pendulum needle 44 extends adjacent to and parallel range bar 48.

To mark markings 52 on the range bar the procedure is as follows. Set the first sight pin for a selected range distance, such as 10 yards. If this is the closest distance the ten yards sight pin will be the top sight pin. The archer then holds the bow with bow string 18 drawn and looks through sight 20 and holds the bow to align the 10 yard sight 52. While holding on the target the position of needle 44 is noted on range bar 48 with a marking 52. This procedure is repeated for each of the range pins 34, such as at 10 yard intervals. In this way the archer, when using the bow which has been calibrated, can verify the correct position of the bow for each selected range by observing that the needle 44 is in alignment with the proper marker 52.

Figure 7:
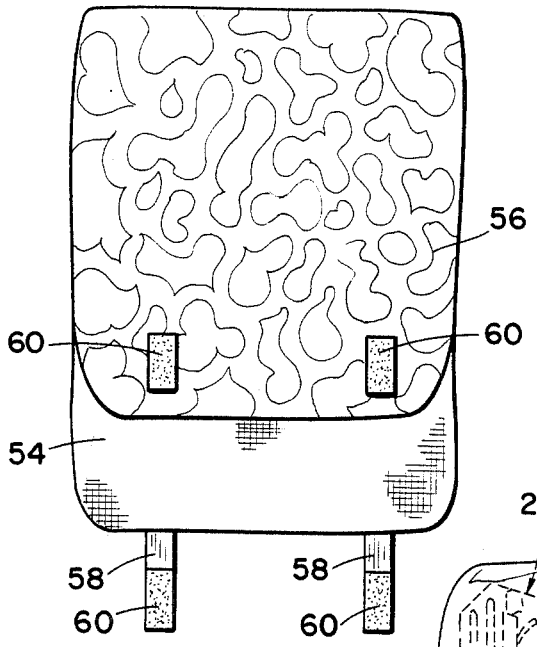
FIG. 7 is an external view of a cover which is preferably employed for covering the range finder sight when not in use.
Figure 6:
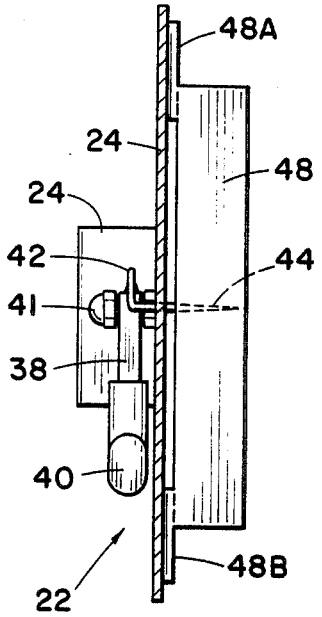
FIG. 6 is an elevational cross-sectional view taken along the line 6—6 of FIG. 2 showing more details of construction of the pendulum member.
Figure 8:
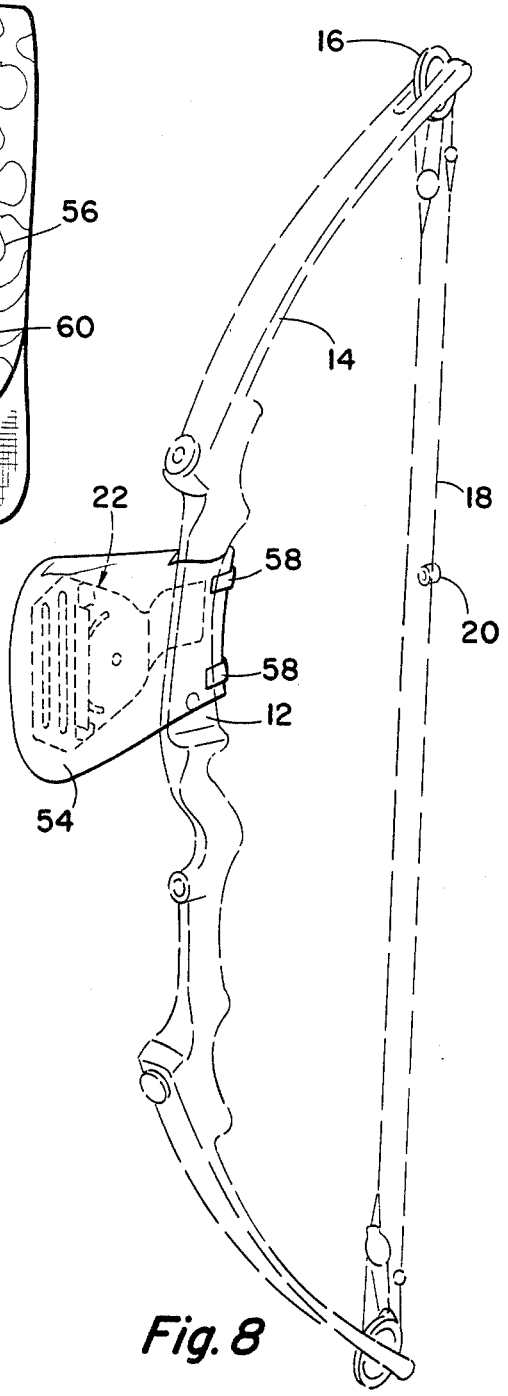
FIG. 8 is an isometric view of a compound bow shown in dotted outline with the cover of FIG. 7 on the bow covering the range finder sight, the range finder sight being shown in dotted outline as contained within the cover.

FIG. 7 is an illustration of a covering which is preferably employed over the range finder sight when the bow is not in use. The cover is in the form of a sack portion 54 with a flap 56. Straps 58 are provided with velcro fasteners 60. When the sack portion 58 is placed over the range finder sight 22, as shown in FIG. 8, the flap portion is closed and velcro retainers 60 serve to hold it in position. In order for the range finder sight to function properly the pendulum 38 must be freely rotatable with minimal friction and therefore it is important to keep the sight protected against water, dirt and other contaminations as much as possible.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A range finder sight for a bow comprising:

a frame in the form of a thin sheet having a forward and rearward end, the rearward end having means for mounting on a bow, the frame extending forward and vertically from a bow;

a plurality of vertically adjustably positionable sight pins affixed to said frame forward portion and extending perpendicularly therefrom;

a pendulum member pivotally supported to said frame at a point intermediate said forward and rearward ends, the pendulum member including a downwardly extending weight portion which pivots in a plane parallel the plane of said frame and a pointer portion, the outer end of the pointer portion being bent to form a pendulum needle extending perpendicular to said frame, the pendulum needle being adjacent to and parallel to said sight pins; and a range bar affixed to said frame between said pendulum needle and said sight pins, the range bar extending perpendicular to said frame a length less than said sight pins, the range bar having an indicia receiving surface thereon facing said frame rearward end whereby range markings may be placed on said range bar in conjunction with the settings of said sight pins.

2. A range finder for a bow according to claim 1 wherein said frame has a narrow width slot therein of arcuate shape, the center of curvature of the slot being the point at whch said pendulum member is pivotally supported to said frame, and wherein said pendulum member pendulum portion is on one side of said frame and said pendulum needle extends through said slot.

* * * * *